US005572085A

United States Patent [19]

Choi

[11] Patent Number: 5,572,085

[45] Date of Patent: Nov. 5, 1996

[54] ELECTRON GUNS FOR COLOR CATHODE RAY TUBE

[75] Inventor: Jin Y. Choi, Kyungsangbuk-do, Rep. of Korea

[73] Assignee: Goldstar Co., Ltd., Seoul, Rep. of Korea

[21] Appl. No.: 353,308

[22] Filed: Dec. 5, 1994

[30] Foreign Application Priority Data

Nov. 4, 1994 [KR] Rep. of Korea ..... 28895/1994

[51] Int. Cl.[6] ..... H01J 29/50

[52] U.S. Cl. ..... 313/414; 313/412; 313/449

[58] Field of Search ..... 313/414, 412, 313/413, 448, 449

[56] References Cited

U.S. PATENT DOCUMENTS

| | | | |
|---|---|---|---|
| 4,086,513 | 4/1978 | Evans, Jr. | 313/414 |
| 4,900,980 | 2/1990 | Peels | 313/414 |
| 4,990,822 | 2/1991 | Guzowski et al. | 313/414 |
| 5,023,508 | 6/1991 | Park | 313/449 |

*Primary Examiner*—Nimeshkumar Patel

*Attorney, Agent, or Firm*—Fish & Richardson, P.C.

[57] ABSTRACT

An electron gun for a color cathode ray tube is disclosed in which a correction electrode having horizontally elongated electron beam passing holes is fixed in a second accelerating/focusing electrode located between an inner shield fixed to the second accelerating/focusing electrode and a shield cup, thereby correcting astigmatism of an electron beam.

9 Claims, 4 Drawing Sheets

ELECTRON GUNS FOR COLOR CATHODE RAY TUBE

BACKGROUND OF THE INVENTION

The present invention relates to a correction electrode fixed in a shield cup, in electron guns fixed to the neck of a funnel and for emitting electron beams, for preventing the electron beams from being distorted at the center and periphery of a screen by reducing the astigmatism of a main lens.

Referring to FIG. 1 showing an example of general electron guns, disposed in line are an electron beam forming portion having a cathode 1 for emitting thermions according to red, green and blue electric signals input after being heated by a heater, a first grid electrode 2 installed on one side of the cathode and for controlling the electron beams emitted from the cathode, and a second grid electrode 3 installed on one side of the first grid electrode and for attracting and accelerating the thermions gathered around the cathode, and a first accelerating/focusing electrode 4 and second accelerating/focusing electrode 5 for forming a main focusing lens for thinly focusing the electron beams serially incident from the electron beam forming portion and thereby forming electron beam spots.

Here, for electron guns in multilevel focusing type, as shown in FIG. 2, a third grid electrode 6 and fourth grid electrode 7 for front stage focusing are added to form a front stage focusing lens, between the electron beam forming portion and the electrodes for forming the main focusing lens.

The electrodes each having three electron beam passing holes for passing the red, green and blue electron beams produced from cathode 1 are integrally fixed by a pair of bead glass at a predetermined interval.

In conventional electron guns, as cathode 1 is heated by the heater and thermions are emitted therefrom, electron beams are controlled by first grid electrode 2, and simultaneously accelerated by second grid electrode 3 and pass through the main lens, i.e., first accelerating/focusing electrode 4 and second accelerating/focusing electrode 5. By doing so, the electron beams are thinly focused and accelerated due to the difference of voltage applied to first accelerating/focusing electrode 4 and second accelerating/focusing electrode 5, to thereby cause a phosphor coated on the inner surface of a panel to be luminous. This realizes an image on a screen.

In these conventional electron guns, the electron beam passing holes are perforated in almost full circle from the first grid electrode 2 to second accelerating/focusing electrode 5 so that the main focusing lens formed by the first accelerating/focusing electrode 4 and second accelerating/focusing electrode 5 becomes a circular co-axial symmetric lens. Thus, when voltages required in the operation of electron guns are applied, the electron beams passing the electron beam passing holes are converged rotation-symmetrically according to the Lagrange's law so that the electron beams are circular when starting from the electron guns, and thinly focused in circle when reaching the center of screen. In this stage, the electron beam forms a small circular spot.

Images are realized as the electron beams emitted from the electron guns are projected throughout the screen by the deflection magnetic field of a deflection yoke.

In the above operation, when the electron beams pass through second accelerating/focusing electrode 5, if there is no correction electrode (not shown) for shielding and weakening the leakage magnetic field of the deflection yoke acting as the electron beams, the convergence can be properly adjusted by changing the shape and location of the inner shield fixed in the second accelerating/focusing electrode 5. However, the astigmatism cannot be properly adjusted and the diverging field is weakened in the diverging area of second accelerating/focusing electrode 5 to reduce the electron beams' vertical divergence amount. This creates a halo phenomenon at the center and periphery of the screen.

In order to overcome this problem, there was proposed a technique in which a correction electrode is installed between second accelerating/focusing electrode 5 and shield cup 8 so that the convergence is not varied but the astigmatism is varied optimally.

This correction electrode has a divergence field which is strong in the divergence area of second accelerating/focusing electrode 5, increasing the electron beams' vertical divergence amount. Therefore, it corrects the astigmatism without the convergence being affected, obtaining a good beam spot at the center and periphery of the screen.

In other words, the correction electrode diverges the electron beams vertically to vertically elongate the electron beams at the center of screen but to obtain circular beam spots on the periphery thereof. Here, the astigmatism represents the difference between vertical and horizontal voltages of a spot beam formed on the screen. It implies that as the difference becomes greater, the astigmatism also becomes greater. The astigmatism is calculated by the difference between a vertically focused voltage and a horizontally focused voltage.

If the vertical just focus voltage is higher than the horizontal just focus voltage, the astigmatism is negative, and vise versa. If the astigmatism falls within 100–300 (positive), the best electron beam spot can be obtained at the center of screen as well as on the periphery thereof. However, if the astigmatism is negative, the halo phenomenon is severe at the center and periphery of screen.

FIG. 3 is a partially cutaway perspective view of a state in which the conventional electrode is fixed in the shield cup. FIG. 4 is a vertical cross-sectional view of FIG. 3. In this drawing, correction electrode 9 in the form of a horizontal barrier is welded at the upper and lower portions of electron beam passing holes **8*a* formed on shield cup 8 and shield cup 8 to which correction electrode 9 is fixed is inserted and fixed to second accelerating/focusing electrode 5**.

By doing so, when the electron beams emitted from the cathode pass through second accelerating/focusing electrode 5, the magnetic field produced by the deflection yoke can be sufficiently shielded and the astigmatism be corrected without the convergence being affected.

In this structure, however, since, in processing shield cup 8 to which correction electrode 9 is fixed, it is hard for the connection surface, to which the correction electrode is fixed, to be even and for the electron beam passing holes to coincide. This puts the welding points of the correction electrode out of joint so that the passage of electron beam is varied and the precise processing of correction electrode is difficult. This deteriorates resolution.

SUMMARY OF THE INVENTION

Therefore, it is an object of the present invention to provide electron guns for color cathode ray tube which facilitate processing and assembly by varying the structure and installation position of a correction electrode.

To accomplish the object of the present invention, there is provided electron guns for a color cathode ray tube having, in line sequentially from a cathode to a screen, a first grid electrode, a second grid electrode, a third grid electrode, a fourth grid electrode, a first accelerating/focusing electrode, a second accelerating/focusing electrode, and a shield cup, wherein a correction electrode having horizontally elongated electron beam passing holes is fixed in the second accelerating/focusing electrode located between an inner shield fixed to the second accelerating/focusing electrode and the shield cup.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
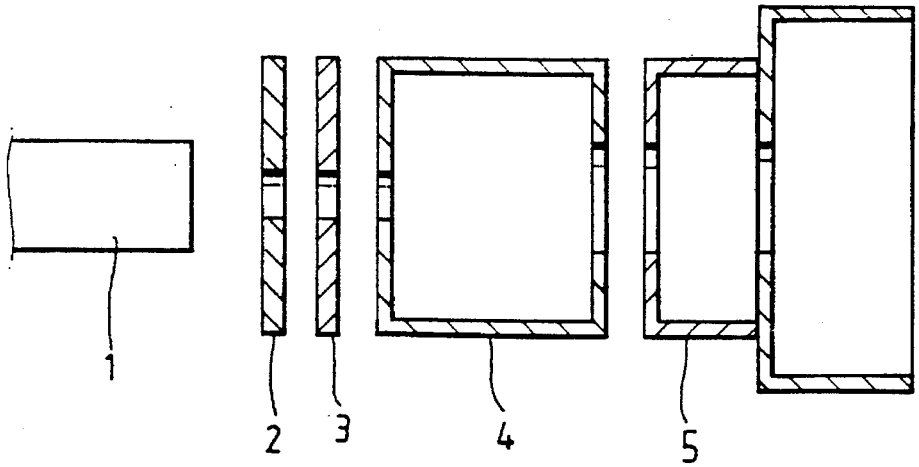
FIG.1 Prior art
FIG. 1 is a vertical cross-sectional view of an example of a general electron gun.
Figure 2:
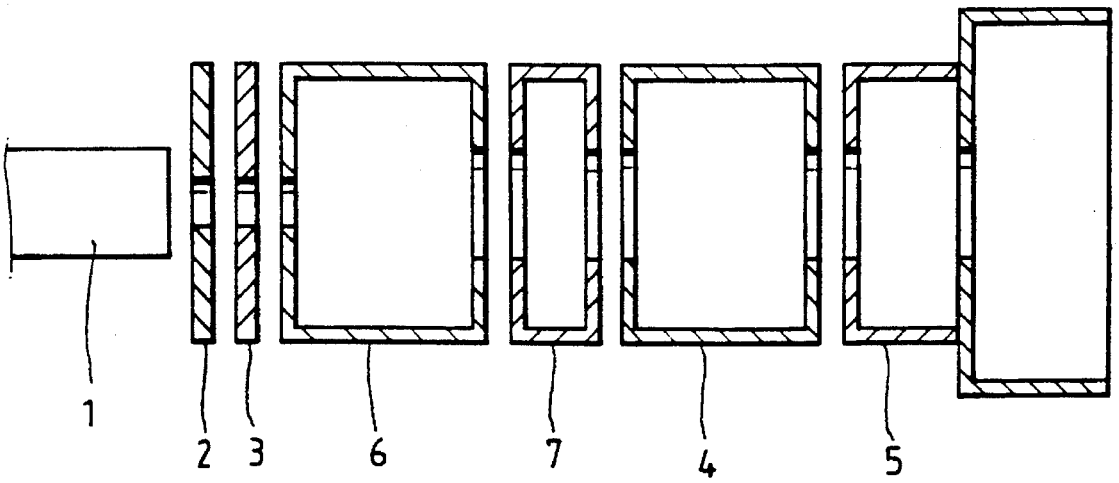
FIG.2 Prior art
FIG. 2 is a vertical cross-sectional view of another example of a general electron gun.
Figure 3:
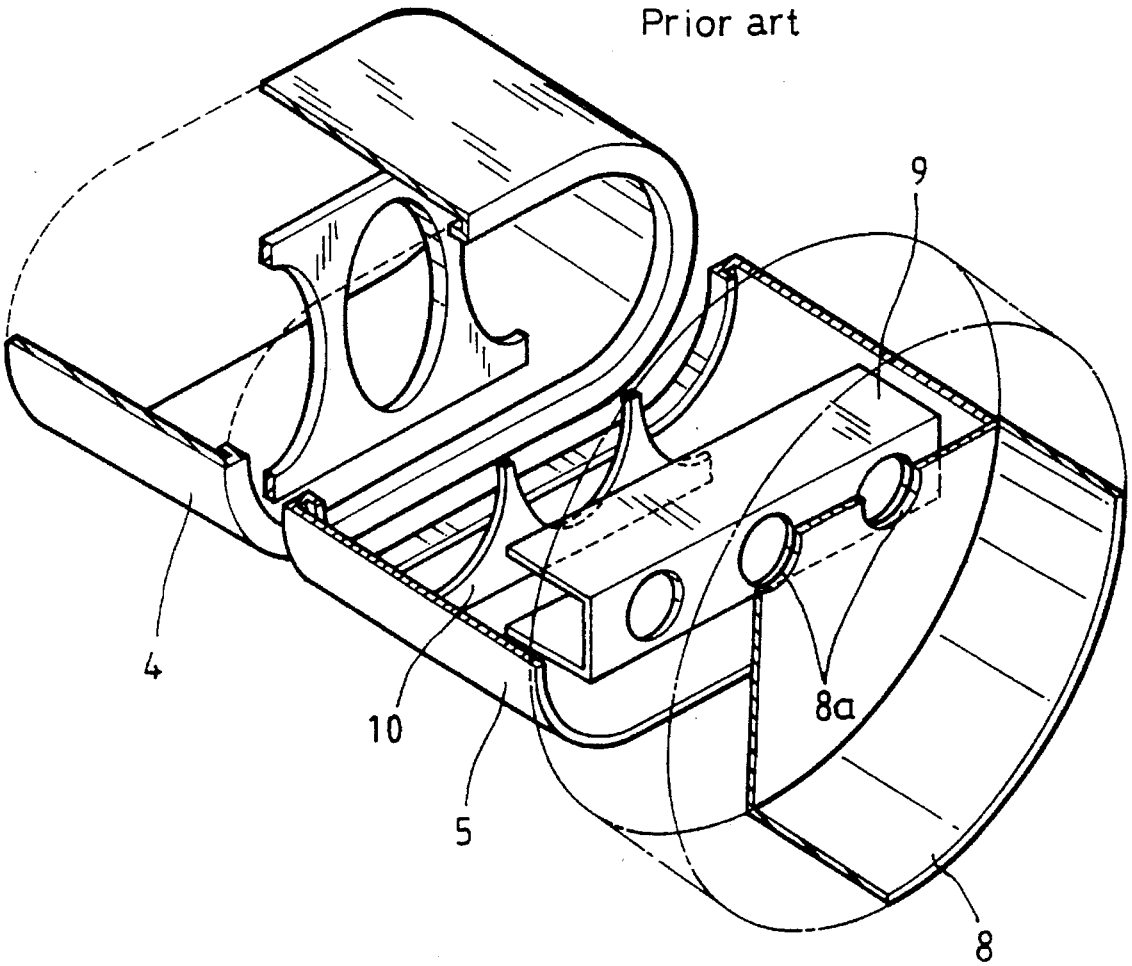
FIG. 3 Prior art
FIG. 3 is a partially cutaway perspective view of a state in which a conventional correction electrode is fixed onto a shield cup.
Figure 4:
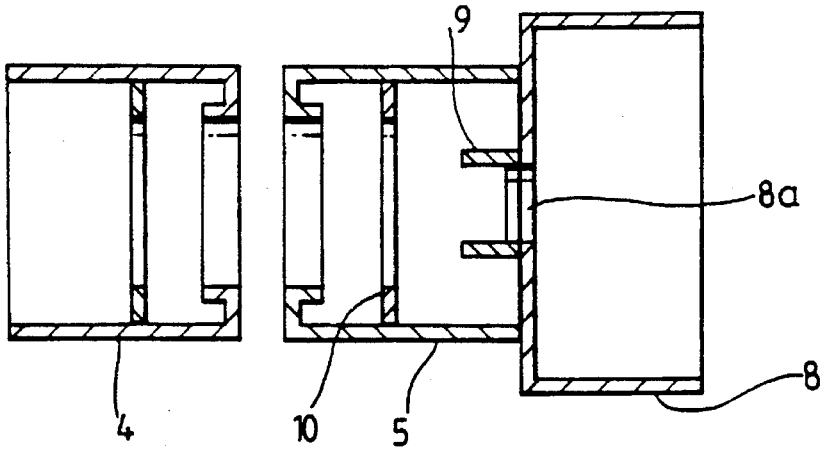
FIG. 4 Prior art
FIG. 4 is a vertical cross-sectional view of FIG. 3.
Figure 5:
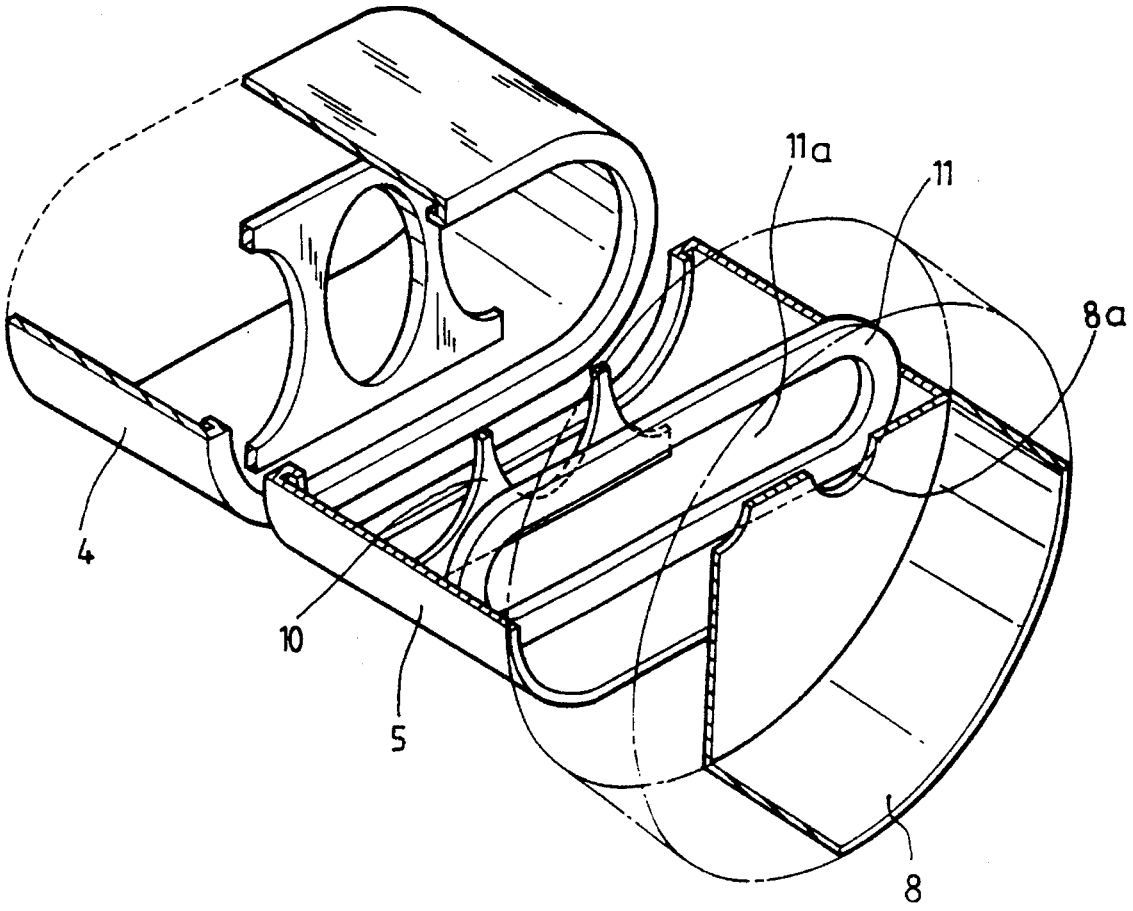
FIG. 5 is a perspective view of an electron gun of the present invention.
Figure 6:
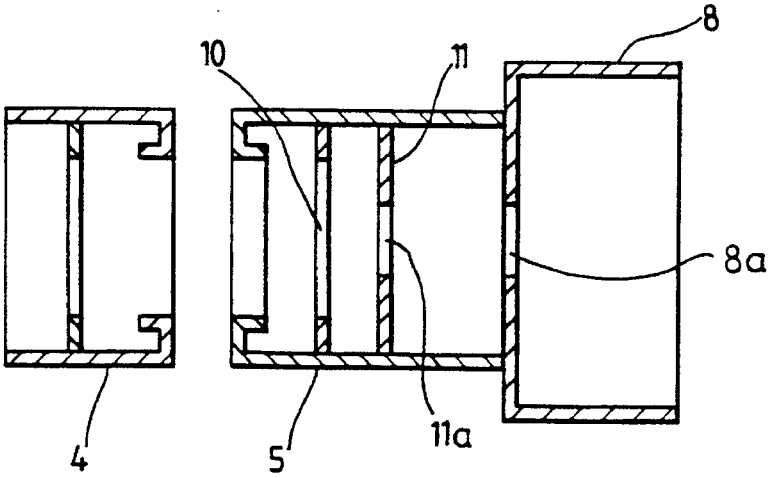
FIG. 6 is a vertical cross-sectional view of FIG. 5.

Referring to FIGS. 5, 6 and 7, like numerals are numbered to like components as in the conventional configuration.

A plate correction electrode 11 in which horizontally elongated electron beam passing holes 11*a* are formed is fixed in the second accelerating/focusing electrode 5 located between an inner shield 10 and shield cup 8 fixed to second accelerating/focusing electrode 5.

Figure 7A:
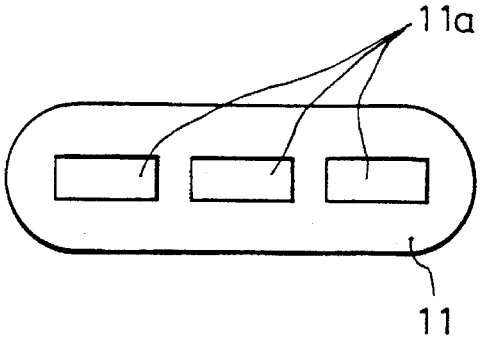
FIGS. 7A–7E are front views of a variety of correction electrodes applied in the present invention.
Figure 7B:
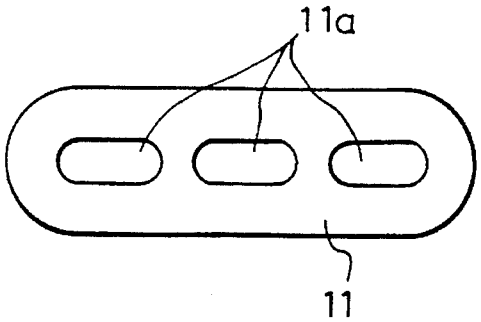
Figure 7C:
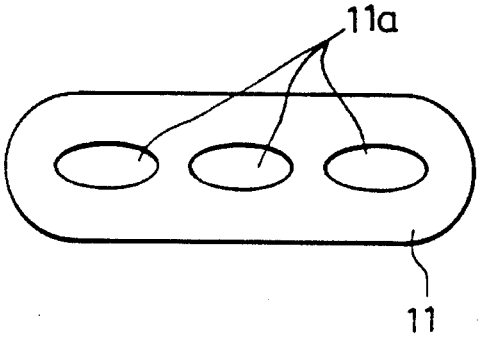
Figure 7D:
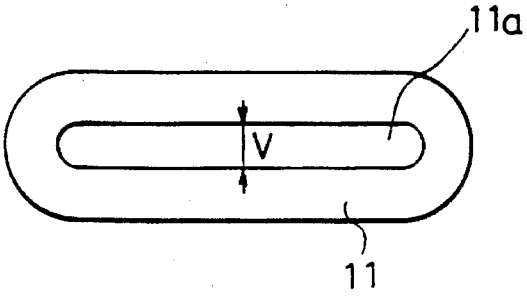
Figure 7E:
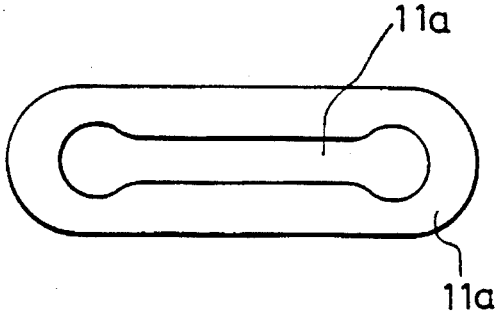

Electron beam passing holes 11*a* formed on correction electrode 11 may be rectangular as shown FIG. 7A, in rectangular with both ends being hemispheric as shown in FIG. 7B, or in ellipse as shown in FIG. 7C. In addition, the electron beam passing holes can be formed as a horizontally elongated single hole with both ends being semicircular or expanded as shown in FIGS. 7D and 7E, respectively.

In correction electrode 11, as the height V of electron beam passing holes 11*a* is lower, the electron beam's divergence amount is increased. As the correction electrode is thicker, the divergence effect is increased. It is preferable that the thickness of correction electrode fall within 0.5–1.0 mm.

It is further preferable that correction electrode 11 be closer to inner shield 10 than to shield cup 8. This is because as the correction electrode is closer to the inner shield, the electron beams are diverged more vertically.

As described above, in the present invention, the correction electrode in which horizontally elongated electron beam passing holes are formed is fixed around the inner shield fixed to the second accelerating/focusing electrode so that the electron beams are diverged more vertically to correct the astigmatism. This realizes a good-quality image.

What is claimed is:

1. An electron gun for a color cathode ray tube comprising:

a first grid electrode, a second grid electrode, a third grid electrode, a fourth grid electrode, a first accelerating/focusing electrode, a second accelerating/focusing electrode, and a shield cup, disposed sequentially from a cathode to a screen; and a correction electrode having at least one horizontally elongated electron beam passing hole, shaped in the form of a plate so as to permit its location to be moved selectively during fabrication between a shield cup and an inner shield, and wherein the correction electrode is fixed in said second accelerating/focusing electrode between the inner shield fixed to said second accelerating/focusing electrode and said shield cup.

2. An electron gun for a color cathode ray tube as claimed in claim 1, wherein said correction electrode is located closer to said inner shield than to said shield cup.

3. An electron gun for a color cathode ray tube as claimed in claim 1 or 2, wherein said correction electrode has more than one independently formed horizontally elongated electron beam passing hole.

4. An electron gun for a color cathode ray tube as claimed in claim 3, wherein each of said electron beam passing holes is rectangular in shape.

5. An electron gun for a color cathode ray tube as claimed in claim 3, wherein each of said electron beam passing holes is elongated in the direction of said other holes with both ends in the elongated direction being semicircular.

6. An electron gun for a color cathode ray tube as claimed in claim 3, wherein each of said electron beam passing holes is elliptical.

7. An electron gun for a color cathode ray tube as claimed in claim 1 or 2, wherein said electron beam passing hole is formed in a horizontally elongated single hole with semicircular ends.

8. An electron gun for a color cathode ray tube as claimed in claim 7, wherein said electron beam passing hole is formed in a horizontally elongated single hole with expanded ends.

9. An electron gun for a color cathode ray tube comprising:

a first grid electrode, a second grid electrode, a third grid electrode, a fourth grid electrode, a first accelerating/focusing electrode, a second accelerating/focusing electrode, and a shield cup, disposed sequentially from a cathode to a screen; and a correction electrode having three horizontally elongated electron beam passing holes for three electron beams made in form of a plate which can be selectively located during fabrication of the second accelerating/focusing electrode between the shield cup and an inner shield for use under different conditions, and wherein the correction electrode is fixed to the second accelerating/focusing electrode.

* * * * *